United States Patent [19]

McCartney

[11] Patent Number: 4,952,096

[45] Date of Patent: Aug. 28, 1990

[54] DYNAMIC EARTH ANCHOR, AND A SLEEVE THEREFOR

[75] Inventor: Clifford A. McCartney, Salem, Va.

[73] Assignee: Ingersoll-Rand Company, Woodcliff Lake, N.J.

[21] Appl. No.: 388,503

[22] Filed: Aug. 2, 1989

[51] Int. Cl.[5] ..... E21D 21/00

[52] U.S. Cl. ..... 405/259; 411/60; 411/479

[58] Field of Search ..... 405/259, 260, 261; 411/479, 520, 516, 521, 60, 61, 62, 15, 39, 64, 65

[56] References Cited

U.S. PATENT DOCUMENTS

| | | | |
|---|---|---|---|
| 1,687,207 | 10/1928 | Hawker | 411/479 X |
| 2,648,247 | 8/1953 | Schmuziger | 411/479 |
| 2,709,389 | 5/1955 | Van Der Kleij | 411/60 |
| 4,012,913 | 3/1977 | Scott | 405/259 X |
| 4,501,515 | 2/1985 | Scott | 405/259 |

*Primary Examiner*—Dennis L. Taylor

*Attorney, Agent, or Firm*—J. R. Bell; B. J. Murphy

[57] ABSTRACT

A dynamic earth anchor, which is forced from a tubular body, comprises a combination of a roof bolt and a tubular, deformable sleeve. The sleeve is insertable into a terrestrial borehole, at a closed end thereof, and then the bolt is inserted into the sleeve. This establishes an almost immediate restraint of the terrestrial formation in which the borehole is formed; the sleeve lockingly secures the bolt, and the bolt causes the sleeve to impress radial forces to the wall of the borehole. The sleeve of the anchor is defined by two edge portions to facilitate its insertion into the borehole, and to permit its slight opening to facilitate bolt entry thereinto the body has an interior and an exterior surface. The slit extends between the interior and exterior surfaces, tangentially intersecting with the interior surface. When the anchor is inserted, it is monitored in a substantially uniform cross sectional width regardless of minor diameter variations of the borehole, which cause sliding of the edge portions. The uniform with results in a substantially even force distribution between the bolt and the interior surface about the entire sleeve.

12 Claims, 1 Drawing Sheet

FIG. 2
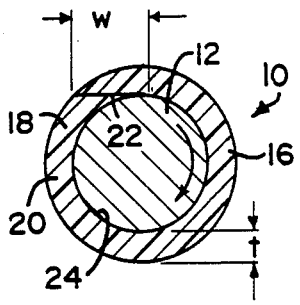
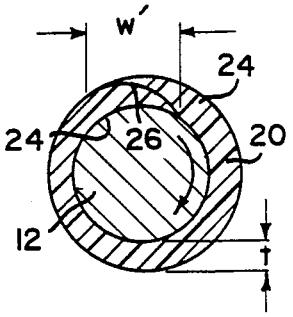
FIG. 4
FIG. 5
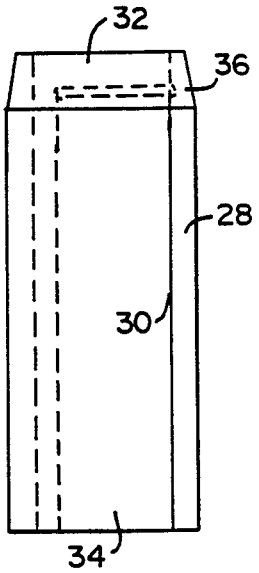
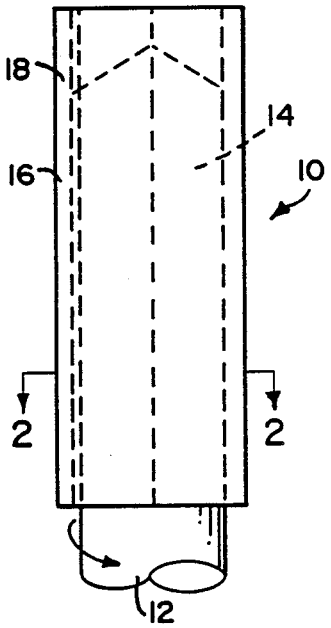
FIG. 1
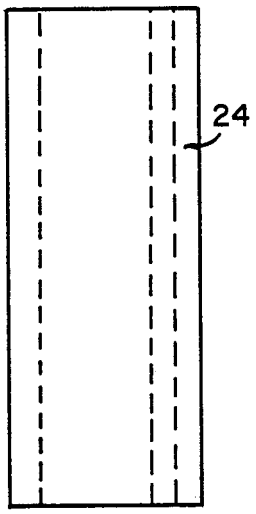
FIG. 3
FIG. 6
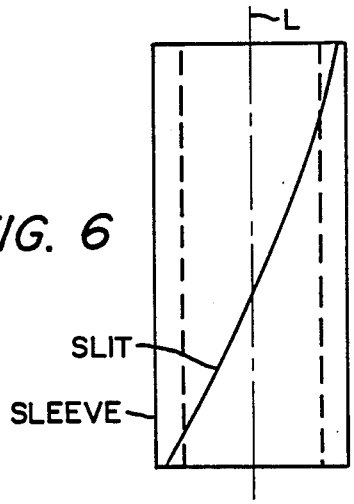

DYNAMIC EARTH ANCHOR, AND A SLEEVE THEREFOR

BACKGROUND OF THE INVENTION

This invention pertains to dynamic earth anchors, or rock stabilizing fixtures, as the same are also identified, and in particular to sleeves for use in such earth anchors.

Dynamic earth anchors, or rock stabilizing fixtures, are well known. Exemplary thereof, and incorporating the use of a sleeve, is the "Dynamic Rock Stabilizing Fixture" set forth in U.S. Pat. No. Re 32645, and issued to James J. Scott.

The fixture in the aforesaid patent comprises a sleeve having a hollow body which is inserted into the end of a terrestrial borehole, and a roof bolt which is then inserted into the borehole-seated sleeve. Typically, the bolt will have threads or other disruptions on the surface thereof to enhance its fast engagement with the sleeve. The combination sets up an almost immediate restraint of the terrestrial formation, and accommodates a roof plate, or the like, at the formation face. Due to the discontinuities and/or asperities in the sleeve-receiving borehole, it is frequently difficult to set the sleeve into the termination of the borehole.

A practical limitation of the aforesaid patent is that, as the required wall thickness of the sleeve or tube increases to accommodate increased annular space between the rod and the wall of the hole in a geologic formation, one or more of the following conditions will exist:

The body cannot be configured as an overlapped tube because:

1. The rigidity and resilience of the thick tube wall resists overlapping.
2. The inner diameter of the overlapped tube becomes too small to permit penetration by the rod.
3. The wall thickness of the tube needed to create proper interference becomes greater than ⅓the diameter of the borehole making it impossible to place the overlapped tube, which will have a minimum diameter of three times the wall thickness in the borehole.

The wall thickness of a continuous tube will either:

1. Prevent entry of the rod into the diameter of the tube.
2. Possess strength sufficient to prevent expansion of the tube to fill the annulus.

The radial expansion of a tube which is split will cause a "C" shaped opening in the cross-section of the tube in the direction of the split creating a loss of radial confinement of the rod, a reduction in compression of the tube, and a resulting degradation of an anchor performance.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the invention, this is accomplished by a sleeve, for use with a roof bolt in a dynamic earth anchor, for (a) an insertion thereof into a terrestrial borehole, and (b) an insertion thereinto of such roof bolt, said sleeve comprising a generally tubular body of deformable material; wherein said body has an elongated wall of substantially circular cross-section; said wall has a given thickness; and said wall has a slit, defined by two edge portions, formed therethrough which extends along a substantial length of said body; and wherein said body has an interior surface and an exterior surface; the slit has a width in transverse of the wall and extends between the surfaces, and intersects the inner surface at a substantial tangential angle. When the anchor is in the inserted position, the interior surface is maintained in a substantially cylindrical configuration about the circumference of the body, regardless of minor diameter variations of the borehole, and the resultant relative overlap the walls on either side of the slit, resulting in substantially equal force distribution between the bolt and the interior surface about the entire bolt.

The foregoing and other aspects will become apparent from the following detailed description of the invention when considered in conjunction with the accompanying drawing figures. It is to be expressly understood, however, that the drawing figures are not intended as a definition of the invention but are for the purpose of illustration only.

BRIEF DESCRIPTION OF THE DRAWING FIGURES

In the drawing:

FIG. 1 is a vertical illustration of a dynamic earth anchor, according to an embodiment of the invention, the same showing only the foremost end of a roof bolt;

FIG. 2 is a cross-sectional view taken along section 2—2 of FIG. 1;

FIG. 3 is a vertical illustration of a sleeve, according to the invention in an embodiment thereof;

FIG. 4 is a cross-sectional view of the FIG. 3 sleeve with a roof bolt;

FIG. 5 is a vertical illustration of another embodiment of the novel sleeve, the same being similar to the novel sleeve of the earth anchor of FIGS. 3 and 4; and FIG. 6 illustrates a slit spirally formed along the longitudinal axis of the sleeve.

DETAILED DESCRIPTION

As shown in FIGS. 1 and 2, the depicted embodiment of a dynamic earth anchor 10, according to the invention, comprises a roof bolt 12 having a foremost, insertion end 14 which is received in a sleeve 16. The sleeve 16 comprises a body 18, of tubular form, and of deformable plastic material. The body 18 has a substantially circular wall 20 of a given thickness t. A slit 22 is formed through the wall 20, and, in this embodiment, extends along the full length of the body 18. The slit 22 is tangent to the inside diameter 24 of the body 18 and, consequently, the slit 22 has a width w, in transverse of the wall 20, which is greater in dimension than the dimension of the thickness t.

The slit 22 makes it possible for the sleeve 16 to contract, as it is inserted into a borehole, whereby its insertion is made much simpler. Too, the slit 22 also permits the sleeve 16 to open, slightly, to facilitate the insertion of the roof bolt 12 thereinto. In that slit 22 is tangent to the inside diameter of the body, a slight parting of the body 18 does not expose the bolt 12 to the wall of the borehole in which the sleeve 16 (and bolt 12) are emplaced. The bolt 12 will remain encircled by the sleeve 16.

During installation thereof, the bolt 12 is normally rotated in the clockwise direction indicated in FIGS. 1 and 2. This imparts a torque to the sleeve 16 which tends to keep the slit 22 closed. Therefore, a more uniform contact of the bolt 12 with the inside diameter of the sleeve 16 is effected, with the slit 22 being wider than the thickness of wall 20.

FIGS. 3 and 4 illustrate another sleeve 24 which is substantially identical to sleeve 16, except that the slit 26 describes an arc between the inside and outside diameters of the sleeve 24. By this expedient, the width w of the slit 26 is significantly greater in dimension than the thickness t of the wall 20 of sleeve 24.

Sleeves 16 and 24, of FIGS. 1 through 4, have slits 22 and 26, respectively, which extend the full length thereof. In some circumstances it will be found useful to have sleeves which retain and maintain their tubular integrity, and which, nonetheless, can be inserted into a borehole with facility and without great difficulty receive a roof bolt therewithin. Such a sleeve is depicted in FIG. 5.

Sleeve 28 of FIG. 5 is substantially identical to sleeve 24 of FIGS. 3 and 4, except that the slit 30 therein does not extend to the leading end 32 of the sleeve 28 (while it does run to the trailing end 34 thereof). Rather, the leading end portion 36 of the sleeve 28 comprises an uninterrupted, continuous band. Too, portion 36 is slightly tapered. The portion 36 will maintain the tubular integrity of the sleeve 28, while the taper thereof will facilitate entry of the sleeve 28 into a borehole.

As a further alternative, FIG. 6 illustrates that any of the above-described slits can be spirally formed along the longitudinal wall of the sleeve having a longitudinal axis L, thus providing a more uniform compression during insertion of the sleeve in the borehole. As a result, a more uniform expansion of the sleeve occurs as the roof bolt rod is inserted into the sleeve. This also allows a more uniform compression of the sleeve between the bolt and the wall of the borehole.

While I have described my invention in connection with specific embodiments thereof it is to be clearly understood that this is done only by way of example, and not as a limitation to the scope of my invention, as set forth in the appended claims.

What is claimed is:

1. A dynamic earth anchor, for stabilizing a terrestrial formation, including a roof bolt, and a sleeve for (a) an insertion thereof into a terrestrial borehole, and (b) an insertion thereinto of said roof bolt, said sleeve comprising:

a generally tubular body of deformable material;

said body having an elongated wall of substantially circular cross-section;

said wall having a given thickness;

a slit, defined by two edge portions, extending along a substantial length of said body;

said body has an interior surface and an exterior surface; and said slit extends between said interior and exterior surfaces, and intersects the interior surface at a substantial tangential angle;

wherein when the anchor is in an inserted position, the wall maintains a substantially uniform cross sectional thickness about the circumference of the body, regardless of minor diameter variations of the borehole and a resultant relative sliding of the edge portions, the uniform thickness causes a substantially even force distribution between the bolt and the interior surface about the entire sleeve.

2. A dynamic earth anchor according to claim 1, wherein said slit extends between the interior and the exterior surfaces, and describes an arc therebetween.

3. A dynamic earth anchor according to claim 1, wherein said body further has means for maintaining a tubular integrity thereof.

4. A dynamic earth anchor according to claim 3, wherein said integrity-maintaining means comprises an endless band formed of a portion of said body.

5. A dynamic earth anchor according to claim 4, wherein said body has leading and trailing ends, with respect to a terrestrial borehole into which it is insertable; and said band is formed at one of said ends of said body.

6. A dynamic earth anchor according to claim 4, wherein said body has a leading end, with respect to a terrestrial borehole into which it is insertable; and said band is formed at said leading end of said body.

7. A sleeve, for use with a roof bolt in a dynamic earth anchor, for (a) an insertion thereof into a terrestrial borehole, and (b) an insertion thereinto of such said sleeve comprising: roof bolt, said sleeve comprising:

a generally tubular body of deformable material;

said body has an elongated wall of substantially circular cross section;

said wall has a given thickness;

said wall has a slit, defined by two edge portions, formed therethrough which extends along a substantial length of said body; and said body has an interior surface and an exterior surface;

said slit extends between the interior and exterior surfaces and describes an arc therebetween, and intersects the interior surface at a substantially tangential angle, wherein when the anchor is in an inserted position, the wall maintains a substantially uniform cross sectional thickness about the circumference of said body regardless of minor diameter variations of the borehole and a resultant relative sliding of the edge portions, the uniform thickness cause a substantially even force distribution between the bolt and the interior surface about the entire bolt.

8. A sleeve according to claim 7, wherein said body further has means for maintaining a tubular integrity thereof.

9. A sleeve according to claim 8, wherein said integrity-maintaining means comprises an endless band formed of a portion of said body.

10. A sleeve according to claim 9, wherein said body has leading and trailing ends, with respect to a terrestrial borehole into which it is insertable; and said band is formed at one of said ends of said body.

11. A sleeve according to claim 9, wherein said body has a leading end, with respect to a terrestrial borehole into which it is insertable; and said band is formed at said leading end of said body.

12. A sleeve according to claim 7, wherein said slit is formed spirally along the elongated wall of the sleeve.

* * * * *

UNITED STATES PATENT AND TRADEMARK OFFICE

CERTIFICATE OF CORRECTION

PATENT NO. : 4,952,096

DATED : 08/28/90

INVENTOR(S) : Clifford A. McCartney

It is certified that error appears in the above—identified patent and that said Letters Patent is hereby corrected as shown below:

Claims: Claim 1, column 4, line 2, delete "causes" and insert--causing--.

Claim 7, column 4, line 46, delete "cause" and insert--causing--.

Signed and Sealed this

Twenty-fourth Day of December, 1991

*Attest:*

HARRY F. MANBECK, JR.

*Attesting Officer*

*Commissioner of Patents and Trademarks*